United States Patent [19]

George, Jr.

[11] Patent Number: 4,665,470

[45] Date of Patent: May 12, 1987

[54] DECORATIVE LIGHT TUBING AND METHOD OF MANUFACTURE THEREOF

[75] Inventor: Benjamin B. George, Jr., Santa Ana, Calif.

[73] Assignee: Tivoli Industries, Inc., Santa Ana, Calif.

[21] Appl. No.: 896,425

[22] Filed: Aug. 13, 1986

[51] Int. Cl.[4] ..... F21V 15/00; F21V 23/00

[52] U.S. Cl. ..... 362/236; 362/238; 362/240; 362/248; 362/249; 362/390; 362/806; 427/105; 427/164; 427/235

[58] Field of Search ..... 362/236, 238, 240, 248, 362/249, 390, 806; 427/105, 164, 235

[56] References Cited

U.S. PATENT DOCUMENTS

| | | | |
|---|---|---|---|
| 2,421,975 | 6/1947 | Williams | 427/235 |
| 3,633,023 | 1/1972 | Castiglioni | 362/249 |
| 3,745,042 | 7/1973 | Lim | 427/164 |
| 4,112,485 | 9/1978 | Sutter | 362/390 |
| 4,521,839 | 6/1985 | Cook | 362/249 |

*Primary Examiner*—Douglas Hart

*Attorney, Agent, or Firm*—Knobbe, Martens, Olson & Bear

[57] ABSTRACT

A decorative light and method of manufacture thereof, said light having an outer transparent tube, a pair of electrical supply wires in the tube, and a plurality of miniature lamps within the tube, the lamps being connected in series between the supply wires, and a protective dielectric material within the tube which coats the supply wires and the lamps forming a protective dielectric cushioning layer between said wires and lamps and the walls of the tube to prevent electrical failure of the decorative light tube circuit as a result of moisture, shock and vibration.

17 Claims, 7 Drawing Figures

DECORATIVE LIGHT TUBING AND METHOD OF MANUFACTURE THEREOF

BACKGROUND OF THE INVENTION

This invention relates to improved decorative light tubing of the type disclosed in U.S. Pat. No. 4,271,458, issued June 2, 1981 and to a method of making the improved decorative light tubing.

Decorative light tubing, which is used in hotels, dance facilities, amusement park rides, and along the aisles of movie theatres to provide decorative lighting, consists of hollow, transparent tubing which houses strings of miniature lamps. The lamps are electrically connected via thin wire leads to a pair of supply wires which have a relatively thin insulative coating. The decorative light tubing is formed in a plurality of sections which are interconnectable via an electrical connector at each end of the section. Many such tubing sections can be joined together to form a long length of continuous tubing.

The lamps used in the decorative light tubing are subminiature, low voltage lamps commonly used for aircraft instrument illumination, and have a rated operating life of more than 40,000 hours. When decorative tubing incorporating these lamps is used in calm environments not subject to shock and vibration, the tubing has an operating life of similar magnitude.

When used in environments subject to shock and vibration such as on amusement park rides, the decorative light tubing fails for a number of reasons. The principal cause of failure is fracture of the tungsten lamp filament. This fracture occurs as a result of embrittlement of the filament that occurs during the first thousand hours of energized life. Vibration waves of a frequency and magnitude so minute as to be unmeasurable without extremely sophisticated sensors will, over a period of time, cause the embrittled filaments to break. In addition, the relatively thin welded wire leads and the soldered connections at which they are attached to the supply wires tend to fracture as a result of metal fatigue induced by vibrational bending. The supply wires which interconnect the miniature lamps rub together, eroding their thin insulative coatings and causing subsequent short circuits. With the passage of time, sections of the decorative tubing fail to illuminate as a result of these vibration-induced problems.

One approach to solving these problems has been to substantially fill the interior of the hollow tubing with a substance to damp the vibration of the string of lamps within the tubing as disclosed in U.S. Pat. No. 4,271,458. Specifically, mineral oil or silicone have been used to substantially fill the interior of the tubing. Both the mineral oil and silicone have proven effective in serving as a dampener to protect the electrical lamps and wiring from breakage due to shock and vibration.

While this approach achieves generally good results with respect to solving the problems caused by vibration, it requires substantial labor in manufacture and requires large volumes of damping material which significantly adds to the cost of the tubing. In addition, the damping material contributes to the weight of the finished product which adds to the cost of shipping.

SUMMARY OF THE INVENTION

The present invention provides advantages heretofore unattained in previous decorative light tubing by providing a novel method of manufacturing decorative light tubing in which a dielectric bonding agent is introduced into the interior of the tubing in order to provide a protective cushioning layer over and around the string of miniature lamps contained therein. Advantageously, the coating bonds the lamps and electrical wiring to the interior walls of the tubing thereby insulating the wiring from any movement which might cause breakage or fraying of the delicate wiring. In addition, the thin dielectric coating alters the resonant frequencies of the lamps so that the lamp filaments cannot respond to the harmonics of the source of vibration.

Decorative light tubing manufactured in accordance with this method is not prone to electrical failure due to shock and vibration. Since the delicate miniature lamps do not respond to the harmonics of vibration, the lamp filaments are protected from breakage due to shock and vibration. In addition, the supply wires which interconnect the miniature lamps and the thin wire leads from the lamps are effectively coated and/or cushioned against the interior walls of the tubing such that the thin insulative coating on the wires is not worn through as a result of the wires rubbing together or through exposure to shock and vibration, thus preventing short circuits.

This method includes introducing a quantity of a viscous dielectric substance into the tubing through an opening in the tubing, the quantity of dielectric substance introduced being substantially less than the quantity of the substance that would be required to substantially fill the interior of the tubing complete with lamps and wiring and causing the dielectric substance to come in contact with and form a coating over and around the string of lamps and wiring within the interior of the tubing.

In this way, only a small percentage of the void volume of the tubing is filled with the dielectric substance. Quite surprisingly, this relatively small percentage of material is as effective in damping vibrations and shock as a tube substantially filled with the substance. Moreover, the aesthetic appearance of the partially filled tubing is striking to the eye. Yet, only a fraction of the material is required resulting in a substantial reduction in cost and weight of the finished product. Moreover, the process of manufacture is quite simple thereby providing for substantailly reduced labor costs in manufacture.

These and other objects, features, and advantages of the present invention will be apparent to those of ordinary skill in the art in view of the detailed description of the preferred embodiment, which is made with reference to the drawings described below.

DETAILED DESCRIPTION OF THE PREFERRED EMBODIMENTS

Figure 1:
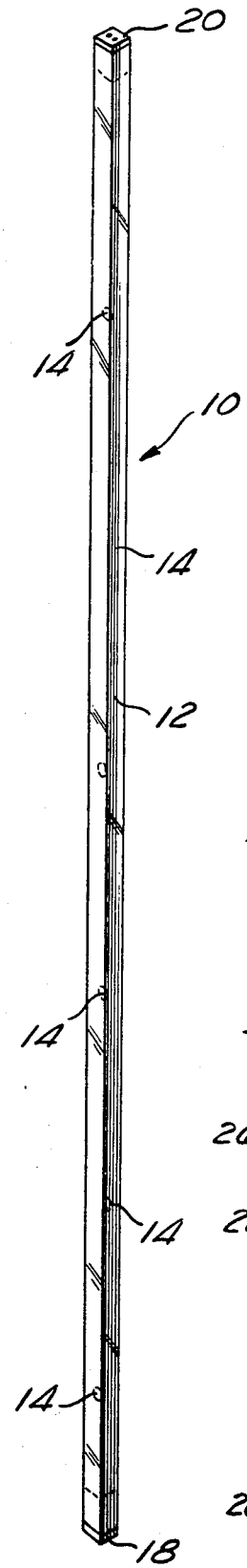
FIG. 1 is a perspective view of a section of decorative light tubing.

FIG. 1 depicts a section of decorative light tubing 10 with a transparent, hollow outer tube 12 and a string of miniature lamps 14 contained within the tube 12. The tube 12 is preferably manufactured of a transparent, flexible, heat-deformable, polycarbonate, polyurethane or polyvinylchloride plastic. The tube 12 has a pair of polycarbonate end caps 18 and 20 at each of its ends.

Figure 6:
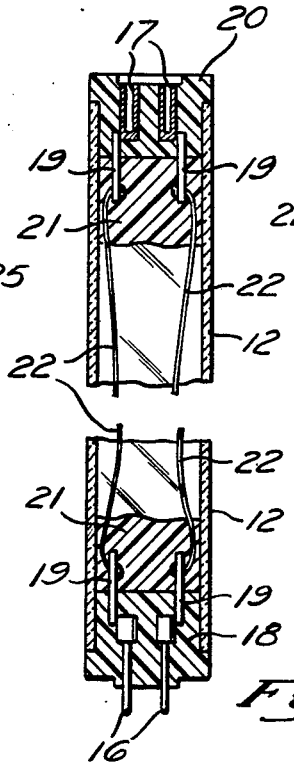
FIG. 6 is a cross-sectional view of the ends of the tubing showing the end plugs and electrical connectors used in the tubing.

Referring now to FIG. 6, the end cap 18 has a pair of protruding metal connectors 16 embedded therein. The end cap 20 has a pair of recessed connectors 17. These electrical connectors 16 and 17 facilitate the interconnection of a plurality of the tube sections 10 permitting the formation of a long string of tubing.

Each of the connectors 16 and 17 is attached to a respective metal pin 19 which is in turn connected by soldering to one of the supply wires 22 thereby providing a voltage differential to the miniature lamps 14 inside the tube 12. If desired, a pair of plastic sealant plugs 21 can be used adjacent the end caps 18 and 20 to form a fluid-tight seal at each end of the tube 12. To form the fluid seal, the plugs 21 are inserted followed by insertion of the end caps 18 and 20 which push the end plugs 21 ahead of them forming the seal.

Figure 4:
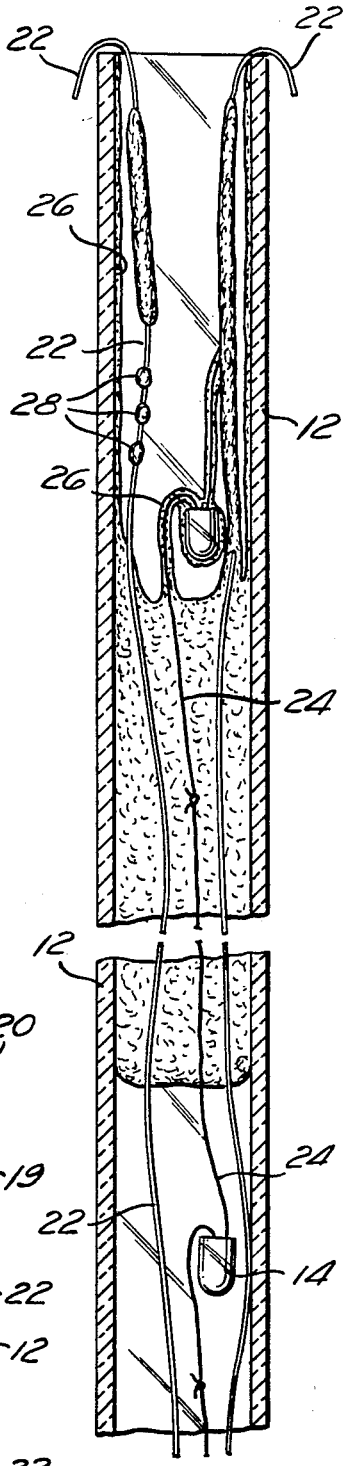
FIG. 4 is an enlarged cross-sectional elevation view of the dielectric substance as it travels through the interior of the tubing under the force of gravity.

Referring now to FIG. 4, the supply wires 22 have a thin insulative coating. The miniature lamps 14, which each have a pair of thin wire leads 24, are connected via these leads 24 to the supply wires 22 in series. These connections are preferably made by auto-splicing welded strings of miniature lamps to the supply wires 22, which are preferably 20 or 22 gauge vinyl or Teflon insulated solid copper wires.

The construction of the decorative light tubing 10 described thus far is generally in accordance with that disclosed in U.S. Pat. No. 4,271,458 issued June 2, 1981 to the same assignee as the present invention. U.S. Pat. No. 4,271,458 is incorporated by reference herein.

Figure 5A:
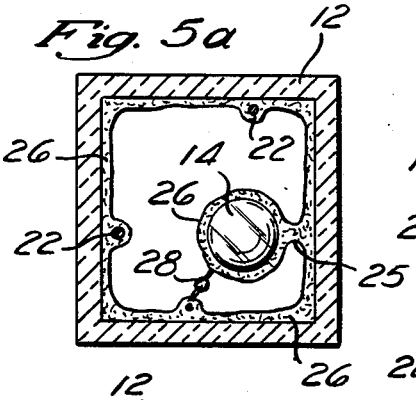
FIG. 5*a* is a cross-sectional view of the tubing showing a miniature lamp and two electrical supply wires in a first position inside the tubing.
Figure 5B:
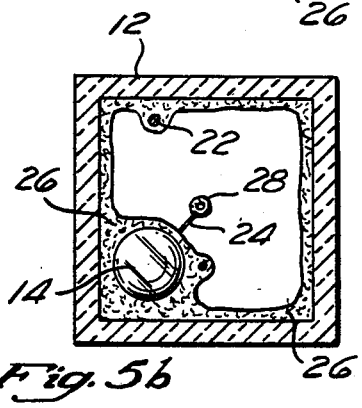
FIG. 5*b* is a cross-sectional view of the tubing showing a miniature lamp and two electrical supply wires in a second position inside the tubing.

As illustrated in FIGS. 4, 5*a* and 5*b*, the tube 12 contains a dielectric coating 26 which forms a protective cushion over and around the lamps 14, the supply wires 22 and the wire leads 24. This coating 26 is of a consistency to provide cushioning from shock and dampening of vibration, as well as a moisture barrier. As will be described in more detail below, advantageously the coating 26 acts as a bonding agent bonding the lamps 14, the supply wires 22, and the wire leads 24 to the interior walls of the tube 12. In this way, the delicate electrical construction within the tube 12 is immobilized and thereby protected from fraying and ultimate breakage caused by movement due to shock and vibration.

In addition, the dielectric coating alters the resonant frequencies of the lamps so that the embrittled lamp filaments do not break due to vibrational harmonics. When the string of lamps is coated with the dielectric substance in this manner, the relatively high resonant frequency of the lamps is lowered so that the lamps and lamp filaments do not respond to the typically higher frequency vibrations inherent in amusement park rides and the like, which cause embrittlement and breakage of the lamp filaments.

The coating 26 must be transparent to permit passage of light therethrough, thereby creating the beautiful aesthetic effect of such lighting. Moreover, it must be a dielectric substance and one which does not chemically or otherwise attach the tube 12, the supply wires 22, or the wire leads 24 of the lamps 14.

Importantly, as will become more clear in the discussion below, the coating 26 must have flow characteristics to permit it to flow over and around the lamps 14, the wire leads 24 and the supply wires 22 thereby providing the cushioning layer of protection from shock, vibration, and prevention of electrolysis should moisture enter the tube.

One suitable dielectric substance is a silicone gel. Generally, as further described below, the curing of the gel is catalyst-activated and is essentially temperature independent. The coating 26 therefore will partially cure at room temperature to a soft gel-like consistency which has been found to be excellent in providing the characteristics described above. Such silicone gels are normally crosslinked dimethylpolysiloxanes which are generally known in the art, e.g., U.S. Pat. No. 3,020,260, herein incorporated by reference. Another example is a methyl silicone resin capable of being vulcanized to an elastomer blended with a dimethyl silicone fluid as disclosed in U.S. Pat. No. 3,681,787, herein incorporated by reference. Another example is a reaction product of a mixture of an organosiloxane, a liquied hydrogensiloxane and a platinum catalyst. Another example is a mixture of two components, the first comprising a mixture of vinyl-containing polysiloxanes with the second comprising a hydrogen-containing silane or polysiloxane. Other organopolysiloxane compositions such as room temperature vulcanizable silicon rubber compositions are also suitable. In the preferred embodiment, the dielectric substance is formed from two portions comprising a base and an activator. The base contains vinyl terminated polydimethylsiloxane, trimethyl terminated polydimethylsiloxane, and silicone hydride. The activator contains vinyl terminated polydimethylsiloxane, trimethyl terminated polydimethylsiloxane, and a platinum catalyst. Alternatively, the base solution can contain ethyl silicate in place of the silicone hydride and the activator can contain tin catalyst rather than platinum. Mixing of the base and activator portions, produces a semi-cured, gel-like product which requires about 30 minutes to begin to gel, thereby providing adequate time to permit the manufacture as will be described below.

Although silicone gel is disclosed as the preferred dielectric used to form the coating, any other suitable transparent low temperature curing flexible polymer with equivalent characteristics of curing, viscosity, shock absorption, and compatibility with the tubing may be advantageously utilized in order to obtain the benefits of the invention. As will be understood by those in the art, the dielectric substance will partially cure at a temperature below the softening point of the material comprising the tube 12. Alternatives to the silicone gel are a gel formed from urea formaldehyde and toluene diisocyanate or an adhesive hot melt as is well known in the art. Ingredients of hot melts are polyethylene, polyvinyl acetate, polyamides, hydrocarbon resins as well as some natural resinous materials.

Figure 2:
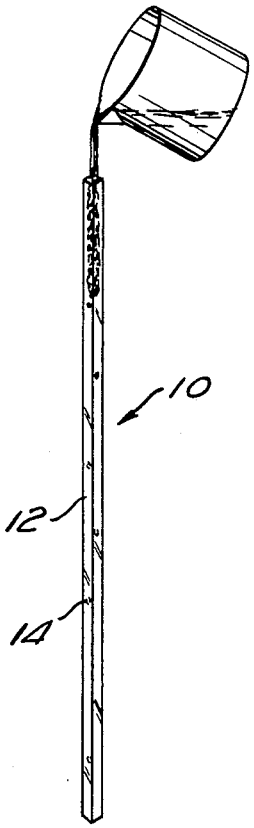
FIG. 2 illustrates the introduction of transparent dielectric substance at the upper opening of a section of hollow tubing containing a string of electrically interconnected miniature lamps.
Figure 3:
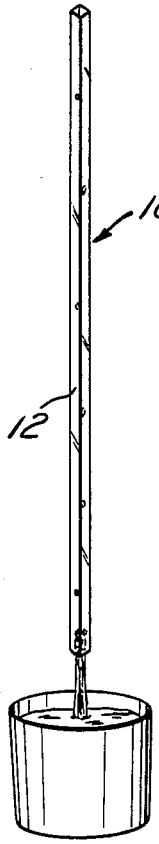
FIG. 3 illustrates the exit from the tubing illustrated in FIG. 2 of the excess of the dielectric substance which has not adhered to the interior of the tubing and the string of lamps.

The tube 12 having the dielectric coating 26 therein is produced by the following preferred method. As illustrated in FIG. 4, a string of lamps 14 is suspended within the hollow tube 12 by bending the supply wires 22 over the top edge of the tube 12. Next, as illustrated in FIG. 2, a quantity of viscous dielectric material is then introduced at the top portion of the tube 12. The viscous solution is formed from two portions which are kept separate until time of manufacture. One of the portions contains an activator. Just prior to introduction into the tube 12, the portions are mixed thereby causing a catalyzed chemical reaction. The dielectric material is poured into the tube 12 until a portion of the tube 12 is completely filled. This may be accomplished because the dielectric material is of such a high viscosity that it travels slowly towards the bottom end of the tube 12 under the force of gravity. In the preferred embodiment, the viscosity of the silicone is between about 5,000 and 10,000 centipoise. As it travels down the length of the tube 12, the dielectric material coats the interior surfaces of the tube 12 along with the supply wires 22, the wire leads 24 and miniature lamps 14. In this way, the dielectric material forms webs stretching between said electrical components and the wall of the tube 12. Upon reaching the bottom of the tube 12, any excess dielectric material which does not adhere to the supply wires 22, wire leads 24, and the lamps 14 is allowed to drip into a container as illustrated in FIG. 3.

This process permits the dielectric material to flow over and around each of the lamps 14, the supply wires 22 and the wire leads 24 thereby forming a protective cushion between these structures and the interior walls of the tube 12.

After the excess dielectric material is drained off, the plugs 21 and the end caps 18 and 20 are inserted to form a seal and complete manufacture.

The quantity of dielectric material remaining after removal of any excess is sufficient to immobilize the lamps 14, the supply wires 22 and the wire leads 24 in forming a protective cushion between these structures and the interior walls of the tube 12. It is found that this occurs at about 10% of the void volume of the tube interior when complete with lamps and wiring. Any quantity of dielectric material which is greater than that sufficient to perform said immobilization is excess. Some excess is acceptable. However, eventually the excess can become geat enough to cause problems such as excessive bubbles in the resulting product. Moreover, as the excess increases, the savings of the present invention with respect to cost and weight become less significant. Preferably then, the dielectric material will not occupy greater than about 50% of the void volume of the tube interior when complete with lamps and wiring. Most preferably, the material will occupy between about 10% and 25% of said void volume.

The quantity of dielectric material introduced at the top of the tube 12 can be premeasured so that there would be no significant excess that would need to be removed at the bottom of the tube 12. When this method is used, the bottom of the tube 12 could already be sealed by the end plug 21, but a suitable ventilation hole would need to be placed near the bottom of the tube 12 to allow the escape of air displaced by the downwardly-moving dielectric material. This ventilation hole could then be plugged.

It should be further understood that instead of coating the string of lamps while in the tube, the string of lamps could be coated with the dielectric substance before being placed within the tube.

FIG. 4 illustrates the gravity-induced flow of dielectric material down the tube 12. The supply wires 22, the miniature lamp 14, and the wire leads 24 shown in the upper portion of FIG. 4 have been coated with the dielectric material. The supply wire 22 on the right-hand side of FIG. 4, the lamp 14, and the wire leads 24 are bonded to the back wall of the tube 12. The supply wire 22 on the left-hand side of FIG. 4 is bonded to the back wall of the tube at its upper portion, but remains unbonded for a portion below the bonded portion. The unbonded portion of the wire 22 has three intermittently spaced dielectric material droplets or beads 28 attached.

Whether the dielectric material bonds the electrical structures to the walls of the tube 12 or simply forms a protective cushioning layer thereon will depend upon several factors. Included amoung them are the proximate position of the lamps 14, the leads 24 and the wires 22 relative to the walls, the amount of dielectric material introduced into the tube 12, the cross sectional area of the tube 12 and the length of the tube 12. Sufficient dielectric material is introduced into the tube 12 to provide for bonding of the lamps 14 to the interior walls of the tube 12. Advantageously, if the leads 24 and the wires 22 are sufficiently proximate to the walls of the tube 12 in comparison with the other factors described above, the dielectric material will tend to bond these structures to the walls of the tube 12 thereby essentially immobilizing them. In this way, these structures are given maximum protection from vibration and shock.

In those areas where the electrical structures are not bonded to the walls, they are nevertheless protected by the insulative coating of the dielectric material. As the dielectric material flows over and around the electrical structures in these unbonded regions, dielectric material beads up, which upon curing, forms protective cushions along the length of the structures.

The unexpectedly effective protection afforded by this process will be better understood with reference to FIGS. 5*a* and 5*b* . FIGS. 5*a* and 5*b* are cross-sectional views of a section 10 of decorative light tubing which has the dielectric coating 26 subsequent to curing inside the tube 12. In FIG. 5*a* , the miniature bulb 14 is coated with dielectric material and is bonded to the interior walls of the tube 12 through a web 25 of dielectric material. in FIG. 5*b* the bulb 14 is also bonded to the interior walls.

When the dielectric coating 26 inside the tube 12 is formed in accordance with this method, the periodically-spaced miniature bulbs 14 are effectively bonded to one or more of the inner walls of the tube 12. The thin wire leads 24 of the bulbs 14 are bonded to the walls of the tube 12 and are coated with the dielectric material for approximately 90% of their lengths. This coating 26 retards vibration-induced metal fatigue, thus reducing the likelihood of the wire leads 24 failing anywhere along their length as well as at the joints at which they are connected to the supply wires 22 in addition to preventing embrittlement and breakage of the lamp filaments.

The supply wires 22 are also bonded to one or more of the inner walls of the tube 12 for approximately 90% of their lengths. As discussed in connection with FIG. 4, the supply wires 22 remain intermittently unbonded to the inner tube walls for short portions of their lengths. This intermittent bonding of the supply wires 22 to the interior tube walls ensures that the wires 22 do not rub together, causing short circuits or broken circuits induced by the erosion of their thin insulative coatings.

Unexpectedly, the above described method produces a product which is as aesthetically pleasing and vibrationally resistant as a tube substantially filled with dielectric material. Moreover, the process is simple to perform and substantially reduces labor costs in manufacture. In addition, significant cost and weight reduction is achieved.

What is claimed is:

1. A method of manufacturing a decorative light tube comprising the steps of:
   (a) providing a plurality of lamps electrically interconnected, said interconnected lamps being sized to fit within a hollow, transparent tube; and
   (b) coating said interconnected lamps with a quantity of dielectric substance, said quantity of dielectric substance being sufficient to form a protective cushioning layer between the interconnected lamps and the walls of the tube and to occupy up to about 50% of the interior of said tube when said interconnected lamps are in said tube.

2. The method of claim 1, wherin said quantity of dielectric substance is sufficient to fill about 10% to about 25% of said interior of said tube when said interconnected lamps are in said tube.

3. The method of claim 1, wherein said dielectric substance is silicone.

4. A method of manufacturing a decorative light tube having a plurality of lamps electrically interconnected by a conductor within a hollow, transparent tube to prevent electrical failure of the lamps caused by vibration of the tube, said method comprising the steps of:
   (a) introducing a quantity of dielectric substance into the tube through an opening in the tube, said quantity being substantially less than the quantity of said substance that would be required to substantially fill the interior of the tube when the electrically interconnected lamps are in the tube; and
   (b) causing said dielectric substance to come in contact with and form a coating on the conductor, the lamps, and the interior of the tube.

5. The method as claimed in claim 4, wherein said quantity of said substance introduced in said step (a) is approximately 10%–50% of the quantity of said substance that would be required to substantially fill the interir of the tube when the electrically connected lamps are in the tube.

6. The method as claimed in claim 5, wherein said quantity of said substance introduced in step (a) is approximately 10% to about 25% of the quantity of said substance that would be required to substantially fill the interior of the tube when the electrically connected lamps are in the tube.

7. The method as claimed in claim 4, additionally comprising the step of (c) causing a portion of said dielectric substance which does not adhere to the conductor, the lamps, and the interior of the tube to exit the tube.

8. The method as claimed in claim 4, wherein said dielectric substance is silicone.

9. The method as claimed in claim 4, wherein the force of gravity induces said substance to flow through the tube from said opening in the tube.

10. A decorative light tube comprising:
   a hollow, transparent tube;
   an electrical conductor in said tube;
   a plurality of lamps in said tube, said lamps being electrically connected to said conductor whereby said lamps are illuminated when an electric current is provided to said conductor; and
   means for bonding said lamps to the interior walls of said tube whereby the resonant frequency of said lamps is substantially reduced so that the filaments of said lamps do not become embrittled and broken as a result of higher frequency vibrations.

11. A decorative light tube comprising:
   a hollow, transparent tube;
   an electrical conductor in said tube;
   a plurality of lamps in said tube, said lamps being electrically connected to said conductor whereby said lamps are illuminated when an electric current is provided to said conductor; and
   a protective coating on said conductor, said lamps, and the interior of said tube formed by:
   (a) introducing a quantity of dielectric substance into the tube through an opening in the tube, said quantity being substantially less than the quantity of said substance that would be required to substantially fill the interior of the tube when the electrically interconnected lamps are in the tube; and
   (b) causing said dielectric substance to come in contact with and form a coating on the conductor, the lamps, and the interior of the tube.

12. The decorative light tube as claimed in claim 11, wherein said protective coating comprises silicone rubber.

13. A decorative light tube comprising:
   a transparent tube;
   an electrical conductor with an insulative coating in said tube;
   a plurality of lamps in said tube, said lamps being electrically interconnected to said conductor whereby said lamps are illuminated when an electric current is provided to said conductor; and
   a protective dielectric coating in said tube, said coating occupying substantially less than the entire internal space in said tube not occupied by said lamps and said conductor.

14. The decorative light tube as claimed in claim 13, wherein said protective coating is formed by immersing said lamps in a dielectic substance and allowing any excess of said substance which does not adhere to drip off said lamps.

15. The decorative light tube as claimed in claim 13, wherein said protective dielectric coating comprises silicone rubber.

16. The decorative light tube as claimed in claim 13, wherein said coating occupies approximately 10%–50% of the internal space in said tube not occupied by said lamps and said conductor.

17. The decorative light tube as claimed in claim 13, wherein said coating occupies approximately 10%–25% of the internal space in said tube not occupied by said lamps and said conductor.

* * * * *